United States Patent [19]

Nelson

[11] Patent Number: 4,521,458

[45] Date of Patent: Jun. 4, 1985

[54] PROCESS FOR COATING MATERIAL WITH WATER RESISTANT COMPOSITION

[76] Inventor: Richard C. Nelson, 31 Sunrise Crescent, Pointe Claire, Quebec, Canada

[21] Appl. No.: 481,300

[22] Filed: Apr. 1, 1983

[51] Int. Cl.[3] ..... B05D 3/00

[52] U.S. Cl. ..... 427/294; 427/295; 427/296; 427/316; 427/318; 427/350; 427/379; 427/385.5; 427/386; 427/387; 427/388.1; 427/389; 427/389.7; 427/393.4; 427/393.5

[58] Field of Search ..... 427/316, 296, 317, 55, 427/350, 299, 351, 294, 385.5, 386, 295, 387, 322, 389, 327, 389.8, 389.9, 389.7, 391, 392, 393, 393.4, 434.7, 393.5, 434.6, 388.1, 372.2, 379; 428/264–268, 289, 290, 426, 475.5, 473, 480; 118/50

[56] References Cited

U.S. PATENT DOCUMENTS

| | | | |
|---|---|---|---|
| 2,012,970 | 9/1935 | Miller | 427/316 |
| 2,867,543 | 1/1959 | Braun | 427/317 |
| 2,930,347 | 3/1960 | Bulloff | 118/50 |
| 3,749,053 | 7/1973 | Timson | 118/50 |
| 4,338,353 | 7/1982 | Melchior | 427/350 |
| 4,348,248 | 9/1982 | Poncet | 427/350 |

FOREIGN PATENT DOCUMENTS

| | | | |
|---|---|---|---|
| 699210 | 11/1953 | United Kingdom | 427/316 |

*Primary Examiner*—S. L. Childs

*Attorney, Agent, or Firm*—Larson and Taylor

[57] ABSTRACT

This invention relates to a process for coating a substratum sheet material, such as woven fabrics, by first removing from the substratum material any moisture that does normally exist therein, and then coating the substratum material with a coating composition with no moisture, air or other impurities being trapped between the substratum and the coating. Novel products produced by this process comprise new compositions of sheet materials having improved weathering characteristics including stability against ultraviolet degradation for improved service in highly transparent or translucent coverings for roofs and solar devices.

9 Claims, 1 Drawing Figure

PROCESS FOR COATING MATERIAL WITH WATER RESISTANT COMPOSITION

Figure 1:
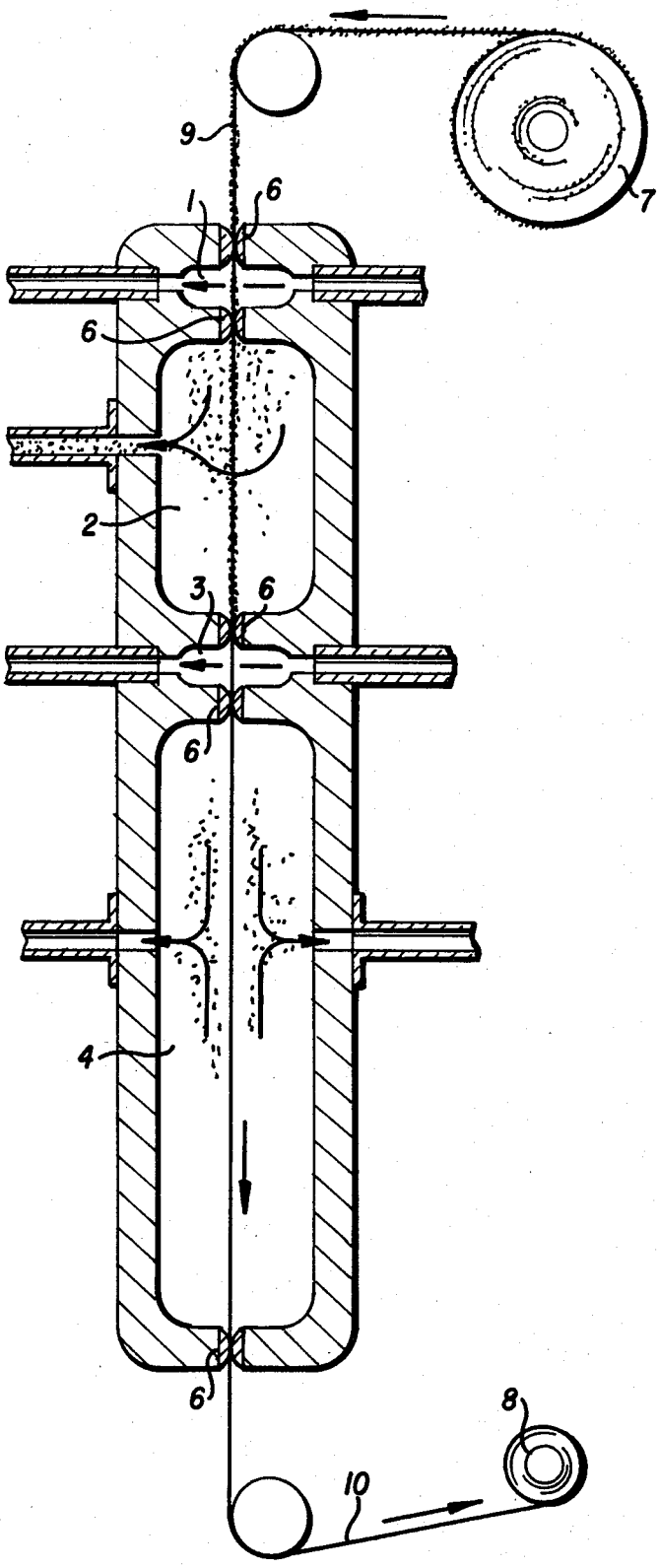

The present invention relates to a process for coating a substratum such as a cloth or fabric with a water resistant composition to produce a weather-proof fabric resistant to exposure to the weather and sunlight.

Water-proof coatings are well known and have been used on fabric and cloth for a number of years. Such coatings however, are generally used with clothes, canvas tarps and the like. There is presently a requirement for a waterproof coating to be used on highly transparent or translucent flexible material such as fabric and cloth, in either permanent or removable structures. Such an application of a water-proof material is in a building system such as that disclosed in my co-pending patent application relating to a canopy system for a building, Canadian Patent Application Serial No. 352286.

In the past, water-proof coatings have been used on yarns, fabrics and the like, without any specific preparation to the yarns and fabrics before the coating step. The coatings have previously been applied to the fabric by spraying, dipping, brushing, flow coating, transfer coating and sometimes by laminating. It is common practice to employ two or more layers of coatings to improve the product quality. In most cases the coating does not penetrate the yarns, but, rather adheres to the surface of the cloth. Thus, especially with multi-filament yarns, there is often air, moisture and perhaps other contaminants trapped within the yarns thus coated over.

It was observed that in dip coating processes where fabrics woven of multi-filamented yarns are drawn through a bath of low viscosity coating resin the final product shows many flaws in the coating due to air bubbles. This air is brought into the bath with the fabric since it is entrained within the yarns. As the fabric leaves the bath some of the bubbles are picked up, and upon drying and curing, leave voids and pinholes in the coating. The faster the rate of fabric travel through the bath the more serious this problem becomes. However slower rates of coating will increase the cost per unit. Therefore a trade-off may be necessary between the cost and the quality of the coated product.

Furthermore, it was noted that the serviceability of the coated product, when exposed to weathering and sunlight, is impaired due, in part, to the presence of air and moisture trapped in the material by the coating. Chemical reactions that cause weakening and embrittlement of the yarn filaments take place in the presence of oxygen, moisture and other impurities. Exposure to sunlight, especially the ultraviolet rays thereof, initiates these degradation reactions in the presence of such impurities.

The high tensile strength yarns are composed of very fine multi filaments. Such types of fabric materials are therefore especially susceptible to degradation reactions because a very large surface area is exposed to the contaminates. Thus although glass is known to be very stable under weathering, fiberglass fabrics are embrittled, weakened and yellowed rather rapidly if not protected by a coating material. If the coating develops fine fissures known as "crazing" due to fatigue, then water and moisture can reach the fiberglass and wick along the yarns. This is the usual mode of failure of composites with fiberglass reinforcements embedded in thermosetting polyester resin.

The mode of failure of hydrocarbon synthetic fibers is similar to that of glass fibers as described above. There is however, in addition to the adsorption of water into the yarn, the absorption of moisture by the polymer itself. These fibers have an affinity for moisture, and tend to have a low to medium moisture content. The presence of the moisture at the sites of chemical degradation reactions is especially important for decomposition and deterioration on exposure to ultraviolet light. Thus for these fabrics their stability under weathering is improved by preventing entrapment of air and moisture in the yarns as previously discussed, and also by preventing the normal moisture regain of the fibers.

Similarly as for synthetics, it is important for fabrics composed of natural fibers to prevent the entrapment of air and moisture in the yarns and to prevent the normal moisture regain of the fibers in order to achieve stability and long service life under exposure to weathering and sunlight.

The failure of such compositions of material is caused primarily by the deterioration of the protective coating which after a certain time in service allows the substratum to be exposed to oxygen and moisture from the atmosphere. However, it is apparent that the material is often exposed to the said impurities by their entrapment within the material by the coating. Further, it is known that the degradation reactions produce reactive agents, so that these reactions are self sustaining and propagating. Therefore the material may be well on the way to its deterioration from within before the coating that protects from outside agents loses its effectiveness.

In general, water-proof coatings have been placed on yarns, fabrics and sheet material such as films and sheet cast or extruded material, and the like, without any specific preparation of these substratum materials before the coating step. Thus existing moisture is entrapped within these substratums to the extent of their affinity for adsorption and absorption of moisture. Furthermore, air and other contaminants can be trapped in the substratum by the coating. The result is often that when ultraviolet light hits this coated fabric, decomposition and deterioration of the fabric occurs at least partially due to the impurities, moisture and air trapped beneath the waterproof coating.

Review of the past art indicates that no specific effort has been made to avoid the presence of moisture in the fibers of a substratum or to avoid the presence of moisture, air and contaminants adjacent to the filaments of the yarns as a means of producing fabric or cloth substratums with improved stability and durability when exposed to sunlight and to the weather.

The presence of the said impurities in the fabric is not considered in the coating of high viscosity resins onto fabric since they cannot penetrate the yarns but, rather, over-coat the fabrics. Therefore these coatings are usually applied by flow coating. A good quality product is obtained by spreading the coating with a knife blade supplied with air pressure. Since the coatings are usually pigmented and otherwise treated for improved weatherability the ultraviolet radiation does not act upon the fabric substratum.

The presence of the said impurities in the fabric has been considered in the coating of low viscosity resins onto fabric to the extent that it has been recognized that the air within the fabric will cause flaws in the final product as a result of the air forming bubbles in the low viscosity resin. To avoid this problem of bubbles produced as the fabric moves through low viscosity resins it was found that the coating resin will not produce bubbles if the resin is transported at the same rate of travel as that of the fabric. This method is typical of the "transfer type" coating process. The low viscosity resin, transported on a moving belt or wheel, contacts the fabric and wicks into it, while moving at the same speed as the fabric. Wetting the fabric by contact or spraying and allowing time for penetration and then dip coating in a resin bath will reduce foaming in the bath. This method is described in Canadian Pat. No. 998,300 and U.S. Pat. No. 3,843,386. Dip coating may be avoided altogether if successive transfer coating runs can build up a sufficiently thick coating over the fabric.

Previously, the above mentioned art has been employed to produce opaque products and thus the role of the said impurities entrapped in the material as agents for the degradation of the fabric has not been important, since the ultraviolet light which initiates the degradation reactions does not reach the fabric substratum. There is presently a need for architectural fabrics of high transparency or translucency for capture of solar energy by the buildings and for natural illumination within the building. It is therefore the object of the present invention to produce novel products wherein a clear, highly transparent and moisture resistant composition penetrates and surrounds yarn filaments avoiding entrapment of air or other contaminants adjacent to the fibers, and avoiding the natural moisture regain and the presence of other volatile contaminants as can exist in the fibers. The moisture resistance of the composition used on the fabric is such as to prevent the fabric's natural affinity for moisture from attracting the moisture from the environment through the coating and into the fibers. Thus the permeability of the coating to water vapour is very low.

The present invention provides a coating process for a fabric or cloth wherein moisture, air and impurities are first removed. The fabric then makes a pass through a coating bath which can employ resins of any specific viscosity, which are clear when cured and do not absorb moisture nor deteriorate when exposed to weathering and sunlight. A preferred resin for use in this process is available from Dow Corning Corporation under the trade mark "R-4-3117 conformal coating" or any other resin type having equivalent characteristics can also be used.

Another object of the process is to attain high rates of fabric travel while producing a product of excellent quality. This is achieved by preventing air entrainment into the bath and by the specific method employed for the resin bath.

A further object of the process is to obtain control over volatiles released during the process. These volatiles can be recovered and liquefied for reuse thus preventing pollution which is a common problem in prior coating processes.

In one embodiment a process is defined as shown in FIG. 1, wherein the process consists of multiple stages of fabric travel, first, through a liquid bath and then immediately into a vacuum chamber. In one embodiment of the invention two such stages are employed. The fabric(9), in the off loom condition and with no pretreatments is taken from a pay-out reel(7) and run through the entire machinery to be attached to the take-up reel(8) where the coated fabric(10) is taken up as a finished product in a roll. In the first stage the fabric enters the first bath(1) through a first slit(6), the lips of the slit being fabricated of low friction and abrasion resistant material. The fabric passes through the first bath chamber(1) and exits through second slit(6) into the first vacuum chamber(2). Similarly, the fabric(9) leaves the first vacuum chamber(2) through third slit(6) proceeding directly into the second bath chamber(3) and thence through fourth slit(6) into the second vacuum chamber(4) and exiting by a final fifth slit(6).

The purpose of the first bath(1) is primarily to serve as a seal against entry of air into the first vacuum chamber(2) in which a high vacuum is sustained. Water or some other liquid or solution is constantly fed to the chamber which provides that the overflow is returned for resupply. It is preferable that this liquid is quite hot so as to heat the fibers to as high a temperature as is consistant with safeguarding their physical properties. Thus the travel distance and the temperature of the bath(1) is to be determined according to the type of material. Then, when the fabric(9) leaves the bath(1) and enters the first vacuum chamber(2) the liquid will flash off as will the absorbed moisture due to the high temperature of the fibers and high vacuum maintained in this chamber(2). It is provided that the first vacuum chamber can be portioned off into regions of progressively higher vacuum by means of pairs of soft rubber rollers or some other device. With reference to the drawing it can be seen that the fabric travels linearly through the various stages of the process.

Any air entering the first vacuum chamber(2) in the yarn is instantly released from the yarn and removed by the vacuum pump. Also since the liquid feed to bath(1) can be pressurized the liquid will tend to wick out the incoming slit counter directionwise to the fabric travel so that air in the yarn will be largely displaced by the liquid before the yarn(9) travels into the bath(1). Cross flow of the bath(1) liquid through the fabric can further assist to remove air and physical impurities from the fabric(9). The bath(1) supply and recycle circuits should therefore be fitted appropriately with filters and de-airing holding tanks.

The first bath(1) also may serve some pretreatment of the yarns such as heat setting to provide shrink resistance, or provide some chemical modification of the fibers or any combination of such uses including dying and the like prior to coating. The liquids employed in the first bath(1) must however be highly volatile so as not to remain in the yarns on entering the first vacuum chamber. Thus there is no interference from the first bath that reduces the effectiveness of the release of absorbed moisture from the fibers.

Therefore, according to the method of the present invention there will not exist any moisture in the fibers of the fabric(9) nor any moisture or air in the yarns, except in very small traces. And any such small traces of vapours will be easily displaced by liquid coating bath(3), which, supplied under pressure will penetrate completely and fill the voids in the yarn, surrounding every filament. In the embodiment of the invention as we are now describing, the second bath chamber(3) is the coating chamber(3). The coating liquid supply should be at such a flow rate that a cross flow exists with an over-flow from the bath(3) which is resupplied. In this circuit a de-airing holding tank is used. The coating liquid is supplied under pressure to cause a certain amount of counter direction flow and such that the coating liquid is extruded from the coating chamber(3) into the second vacuum chamber at a rate corresponding to the fabric rate of travel. The exit slit(6) can have hard edged lips or hard rollers to nip back the coating resin and allow a specific thickness of the coating film over the surface of the fabric. A predetermined nip pressure controls the quantity of resin remaining on the fabric.

The second vacuum chamber(4) is provided for the drying and curing of the resin. A preferred embodiment employs a low vacuum with an inert atmosphere such as nitrogen. The low vacuum assist the evaporation of the volatiles from the coating resin so that curing can begin. Direct or infrared radiant heating can be employed for promoting the fast curing of the thermo-setting resin.

The penetration of the resin into the fabric provides improved adhesion. Pressure, and elevated temperature assists high viscosity resins to properly penetrate the fabric. Since the fabric can travel quite quickly through the coating chamber(3) a very short interval exposure to high temperatures often will not harm the fabric substratum. This is especially true for glass fabrics which can be exposed briefly to temperatures exceeding 1000° F. and also for polyesters and some other synthetic fabrics which can be exposed briefly to temperatures exceeding 400° F. Thus the method of coating application of the present invention provides that thermoplastic materials can be supplied to the coating chamber(3) as a hot melt. This method may also employ volatile solvents to assist in lowering the temperature of the melt or improving the viscosity. The volatiles can then be recovered and liquefied by exhausting them from the second vacuum chamber(4). A low vacuum will assist the evaporation of the solvents.

In another embodiment the coating is a liquid resin, supplied at room temperature to the coating chamber(3), which cures by means of thermo-setting mechanism. Therefore upon exiting from the coating chamber(3) the fabric may enter a two or three stage curing chamber(4) as is common practice with coating resins. The use of a catalyst and elevated temperature can allow the coated fabric to exit and be taken-up on a reel within 30 minutes of travel time within the curing chamber.

The method herein of utilizing the baths as seals against entry of air into the process improves the quality of the resulting product but also at the same time prevents exposure of the process volatiles to the environment, and contains them for collection and reuse. This has both environmental and economic benefits. Many of the solvents or treatments that could be employed evolve very toxic volatiles which pollute the environment and are not easily eliminated or removed from the exhaust of coating process employed in the prior art.

In a further embodiment a 3 or 4 stage process is visualized including pretreatment bath for substratum preparation, coating, secondary coating and post coating treatments.

By way of example, metallic ions may be deposited on opposite sides of the coated fabric by reaction in successive bath and vacuum chambers following after the coating stage.

The final exit from the mechanism is through a slit or through a pair of resilient surface rollers, or through a final bath with the drying following in the open air. This last bath could be used for a final water cooling, fixing or washing bath or other purpose. The material is then taken up on a reel.

The present invention produces improved products by a novel coating process for various types of compositions that are already known and used such as those comprising acrylobutadiene styrene, acetal, polytetrafluoethylene, polychlorotrifluoroethylene, nylon, phenoxy, polycarbonate, polyamide, polyphenylene oxide, polyethylene, polyvinyl chloride, polyvinylidene chloride, polyvinylidene fluoride, polyester, cellulose acetate, acrylic, epoxy, silicone elastomers, siloxane resins, hexafluoropropylene, polyvinyl fluoride and copolymers thereof. The improved product is a fabric with no moisture, air bubbles or impurities trapped between the fabric and the coating resin. Moisture which normally exist in the fibers is removed before the coating, and the cured resin coating has a lack of affinity for water, thus moisture cannot reach the fibers and normal moisture regain of the fibers is prevented. Known compositions that can benefit by improved properties and process technology of this invention include glass fabric coated with silicone resin or polytetrafluoroethylene polymers. The invention relates to novel compositions that are provided stability against ultraviolet degradation on exposure to weathering, which stability is provided by means of the process. The novel compositions include synthetic and natural fibers having low to medium normal moisture regain, for example polyester fabrics, coated over with a polysiloxane resin such as is available from Dow Corning under the trade name R-4-3117 conformed coating silicone resin.

The present invention offers improved process technology for products other than the transparent or translucent architectural fabrics as discussed above. Indeed any coating on a substratum can advantageously employ the process described. Thus films, slit and woven films, extruded and cast films and sheet material, reinforced films and sheets, fibrous material composed of glass, metal, synthetic hydrocarbons, natural plant and animal fibers comprising continuous sheet material including wovens, scrims, non-wovens, knits, tube-knit and tube-woven goods of any description can advantageously be coated by means of a process embodying this invention, the scope of the process being limited only by the claims.

The embodiments of the invention in which an exclusive property or privilege is claimed, are defined as follows:

1. A continous process for coating a porous fabric sheet in a number of enclosed chambers not exposed to air, comprising the steps of:

linearly feeding the sheet through a first slit into an enclosed preparation chamber, applying hot volatile liquid to the sheet in the preparation chamber, feeding the sheet through a second slit into an enclosed vacuum chamber to remove moisture, air and other impurities and remaining volatile fluids from the sheet, linearly feeding the sheet through a third slit into an enclosed coating chamber, applying a liquid coating to the sheet in the coating chamber, feeding the sheet through a fourth slit into an enclosed further processing chamber to dry and cure the coating on the sheet, and leaving the further processing chamber by a fifth slit.

2. The process of claim 1 wherein the sheet is heated by applying hot volatile liquid in the preparation chamber at a sufficiently high temperature to cause any absorbed moisture existing in the sheet to immediately flash off and leave the sheet upon entering the vacuum chamber.

3. The process of claim 1 wherein the liquid coating is a liquefied thermoplastic delivered to the coating chamber as a hot melt.

4. The process of claim 1 wherein the liquid coating is a thermo-setting liquid resin, including solvents and a catalyst, and the coating is cured at an elevated temperature in the further processing chamber.

5. The process of claim 1 wherein the liquid coating is a liquid with a coating compound as a particulate suspension therein and the further processing chamber is a vacuum chamber for drying and sintering.

6. The process of claim 1 wherein the sheet is selected from the group consisting of extruded and cast films and sheet material, slit and woven films, reinforced films and sheets, fibrous material composed of glass, metal, synthetic hydrocarbons, natural plant and animal fibers comprising continuous sheet material including woven, non-woven, knit, tube-knit, scrim and tube woven goods.

7. The process of claim 3 wherein the liquid coating is selected from the group consisting of ABS, acetal, polytetrafluoroethylene, polychlorotrifluoroethylene, nylon, phenoxy, polycarbonate, polyamide, polyphenylene oxide, polyethylene, polyvinyl chloride, polyvinylidene chloride, polyvinylidene fluoride, polyester, cellulose acetate, acrylic, epoxy, silicone elastomers, siloxane resins, hexa-fluoropropylene, polyvinyl fluoride and copolymers of any of the foregoing.

8. The process according to claim 1 wherein the sheet feeds vertically through the chambers.

9. The process according to claim 1 wherein the liquid coating continuously flows through the linearly moving sheet in the coating chamber.

* * * * *